United States Patent [19]

Herman, Jr.

[11] Patent Number: 4,534,074

[45] Date of Patent: Aug. 13, 1985

[54] BATHTUB CUSHION LIFT STABILIZATION

[75] Inventor: Harry H. Herman, Jr., Bethesda, Md.

[73] Assignee: International Healthcare Products, Inc., Washington, DC

[21] Appl. No.: 581,843

[22] Filed: Feb. 21, 1984

Related U.S. Application Data

[63] Continuation-in-part of Ser. No. 483,301, Mar. 1, 1983, , which is a continuation-in-part of Ser. No. 54,794, Jul. 10, 1979, Pat. No. 4,254,517.

[51] Int. Cl.[3] ..... A47K 3/12

[52] U.S. Cl. ..... 4/564; 4/566; 4/571; 4/578; 4/579

[58] Field of Search ..... 4/571, 566, 564, 499, 4/498, 144.2, 578, 579

[56] References Cited

U.S. PATENT DOCUMENTS

| | | | |
|---|---|---|---|
| 2,725,578 | 12/1955 | Keller | 4/566 X |
| 2,817,096 | 12/1957 | Roth | 4/579 |
| 3,311,930 | 4/1967 | Bourke | 4/566 |
| 3,346,885 | 10/1967 | Merriman | 4/566 |
| 3,771,176 | 11/1973 | Herman, Sr. | 4/578 |
| 4,419,776 | 12/1983 | Schmidt | 4/564 |

*Primary Examiner*—Henry K. Artis

*Attorney, Agent, or Firm*—Beveridge, DeGrandi & Weilacher

[57] ABSTRACT

An apparatus for enabling persons with impaired mobility to enter and leave a bathtub includes a water inflatable shell having a shape such that when fully inflated the shell wedges between opposed bathtub sidewalls and has a top tapering to a platform at about the level of the top of the sidewalls so that the person may lower and raise himself into and out of the bathtub by releasing and adding water from and to the shell, respectively, and the period of time required to transit a distance between the top of the sidewalls and below the top of the sidewalls is briefer than a comparable distance below the top of the sidewalls by virtue of the reduced volume of the tapered top of the shell. Horizontal tubes of elliptical cross section contribute to the tapered shape of the top and add stability.

20 Claims, 4 Drawing Figures

BATHTUB CUSHION LIFT STABILIZATION

BACKGROUND OF THE INVENTION

This application is a continuation-in-part of U.S. patent application Ser. No. 483,301 which has a nominal filing date of Mar. 1, 1983 and an international application filing date of Mar. 9, 1981 and which is in turn a continuation-in-part of U.S. patent application Ser. No. 054,794 filed July 10, 1979, which has since issued as U.S. Pat. No. 4,254,517.

The present invention relates to improvements in bathtub cushion lift assemblies to aid in their manufacture and practical usage.

Many people have difficulty taking unattended baths because of the configuration of conventional bathtubs. Persons such as the handicapped, convalescents, expectant mothers, and the elderly often find it extremely difficult to use conventional bathtubs without assistance. Such difficulties are often focused on their inability to lower themselves into the tube to take a bath, and upon completion of the bath to lift themselves out of the tub. Not only is the entrance and exit into and out of the tub for such users fraught with considerable difficulties, it is also extremely dangerous due to the ever present possibility of slippage. As a result, many of such individuals with impaired mobility must have personal assistance from another to enter and exit the bathtub. Even when the assistant is a close relative such as a spouse, the presence of the person necessarily is an intrusion on the privacy of the bather. Thus, there has been a need in the art for an assembly to aid such bathers in entering and exiting the bathtub in solitude or with only a minimum of assistance from others.

Bathtub cushion lift assemblies are known in the art, such as described in U.S. Pat. No. 3,771,176. In this patent, a cushion lift is described which has an inflatable shell adapted to be positioned on the floor of a bathtub and is connected to the bathtub spout or faucet. Water under pressure is fed through the bathtub spout into the inflatable shell to selectively inflate it to its full elevation, thus elevating its top surface to the approximate height of the bathtub walls. This surface provides a cushion-like support on which a person desirous of taking a bath may sit. Once the person is seated on the cushion-like support in the bathtub, the cushion may be deflated by releasing water therefrom, whereby the person sitting thereon is gradually lowered to the floor of the bathtub. After the bath is completed, the shell may be once again filled to elevate the user to the top of the bathtub, whereby the user may then exit the tub easily. Improvements on the cushion lift of U.S. Pat. No. 3,771,176 are disclosed in the aforementioned U.S. Pat. No. 4,254,517 and copending application Ser. No. 483,301. The disclosures of U.S. Pat. No. 3,771,176 and U.S. Pat. No. 4,254,517 and application Ser. No. 483,301 are incorporated herein by reference.

Through additional extensive research and development applicant has devised further improvements to aid in the ease of manufacture of a bathtub cushion lift and improvements for users. A large water-inflatable shell, when filled with water will have a tendency to take on a spheroid shape and roll or buckle when a weight is placed on it. When a person of impaired mobility places his or her weight on such a shell, rolling or buckling of the shell is a serious disadvantage which may lead the person to feel he or she is falling and may incite panic. The previously cited patent and copending application include means for increasing the stability of the shell when filled with water and these have provided a certain degree of effectiveness, but left room for improvement which applicant has since brought about and discloses herein.

Particularly, the user having impaired mobility is most prone to panic when he or she feels the most vulnerable. This occurs when sitting at the highest elevation with the shell fully inflated such that if the user were to fall he or she would have a maximum distance to fall. Thus, the user's sense of security will be enhanced by minimizing the period of time at which the shell is at the highest elevation, and more particularly minimizing the duration of time of changing elevation at the peak elevation.

SUMMARY OF THE INVENTION

Applicant's improved apparatus enables persons with impaired mobility to enter and leave a bathtub. It includes a water-inflatable shell having a shape such that when fully inflated wedges between opposed bathtub sidewalls and has a top tapering to a platform about the level of the top of the sidewalls. Therefore a person with impaired mobility may lower and raise himself into or out of the bathtub by releasing and adding water from and to the shell, respectively, and thereby the period of time required to transit a distance between the top of the sidewalls and below the top of the sidewalls is briefer than a comparable distance below the top of the sidewalls, by virtue of the reduced volume of the tapered top of the shell.

Preferably, the tapered top is pyramidal. This may be accomplished by providing a tube passing horizontally through the shell and more particularly, two tubes provided spaced apart vertically and being elliptical in cross section, with a major axis of the ellipse extending horizontally. Making the upper tube shorter than the lower tube further contributes to the pyramidal shape. More preferably, the upper tube has an outside lower face and the lower tube has an outside upper face and the outside lower face and outside upper face are provided with means for increasing friction between themselves. A preferred friction increasing means includes hook and loop fabric surfaces affixed to the tubes. Preferably the interiors of the tubes are open to the outside of the shell. If so, a carrying strap may be provided extending through one of the tubes.

The shell is preferably made of sheet material and the seams of the shell used in manufacture are lap welds of the sheet material. The shell has a lateral wall facing one of the bathtub sidewalls, and the lateral wall is provided with a drainage valve, preferably a flop flap valve. Also, preferably the shell is provided with a means for indicating the temperature of the water therein.

BRIEF DESCRIPTION OF THE DRAWINGS

The invention will be better understood from a reading of the following detailed description of the preferred embodiments and a study of the drawings in which.

DETAILED DESCRIPTION OF A PREFERRED EMBODIMENT

Figure 1:
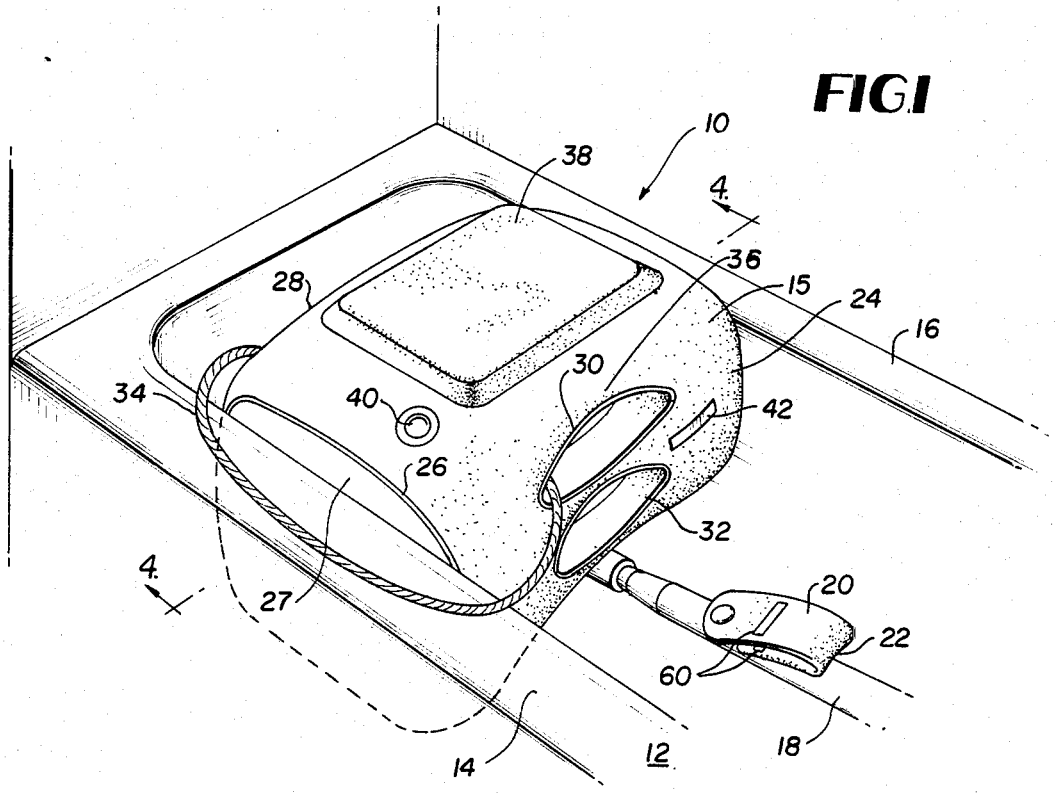
FIG. 1 is a perspective view of a bath lift in a bathtub.

The improved cushion lift assembly 10 is seen in FIG. 1 and placed in a bathtub 12 having opposed sidewalls 14 and 16. The cushion lift assembly includes a shell 15 which when fully inflated with water wedges between the sidewalls 14 and 16. The distance between sidewalls of bathtubs is not uniform, but if the shell is made in a size suitable for the largest conventional tub, it will accommodate most commercially available bathtubs. The shell defines a volume and is made of a sheet material 24 whose seams 26 are lap welds of the material. A preferred material is 50 mil vinyl, although of course many other materials may be substituted. The use of lap welds assures the integrity of the shell under the tensions to which it will be subjected. Each side of the shell is separately closed by an end piece 27, the connection of which can easily be accomplished to finish the shell after other internal welds are made.

The shell includes an inlet tube 18 connected to the tub faucet or shower head, not shown. Various connection means may be used. Inlet tube 18 extends to and communicates with the interior of shell 15 and is provided with an outlet having a main closure valve 20. Main closure valve 20 is conveniently made of a flexible tubing which is folded back on itself at 22 to provide a closure seal. The fold is maintained in position by a fastening means 60 attached to the inside folds of the valve 20, illustrated more clearly in a similar valve in FIGS. 2 and 4.

Defining the end of shell 15 to which main closure valve 20 leads as the front, and the end 28 as the rear, the shell has an upper tube 30 and a lower tube 32 from front to rear extending through it. The tubes 30 and 32 are elliptical in cross section, with the major axis of the ellipse extending horizontally, as can be clearly seen in FIGS. 1, 2, and 4. A carrying strap 34 extends through the upper tube 30 to facilitate carrying the shell when deflated. As can be seen in FIG. 3, the upper tube 30 is shorter than the lower tube 32. This provides several important benefits. First, when the shell is inflated, the shorter upper tube causes the upper region of the shell 15 to constrict from front to rear making a curved indentation 36 to receive the legs of the user. Secondly, it causes the top of the inflated shell to take on a tapered, pyramidal profile. As seen in FIG. 4, the volume of water contained by the shell between elevation C and elevation B is considerably greater than between B and A, although the vertical stances are equal. Thus, assuming a constant rate of water flow to and from the shell during inflation and deflation, the period of time required for the top of the shell to transit the distance between points A and B will be considerably less than between points B and C. The apex of the pyramid is flattened by a stiffening board 38. Various other flattening techniques can be used, as provided in my prior U.S. Pat. No. 4,254,517.

As air valve 40 allows any air which may be in the shell to escape as the shell is inflated. A temperature indicator 42 is provided on the side of the shell to provide the user with an indication of the temperature of the water in the shell. This is particularly useful since the water which is used to inflate the shell is also the water in which the user will bathe. The temperature indicator can be of any suitable type.

As can be seen in FIG. 1, the interior of the tubes 30 and 32 are open to the outside of the shell. However, they could be entirely contained within the shell, if desired.

Figure 2:
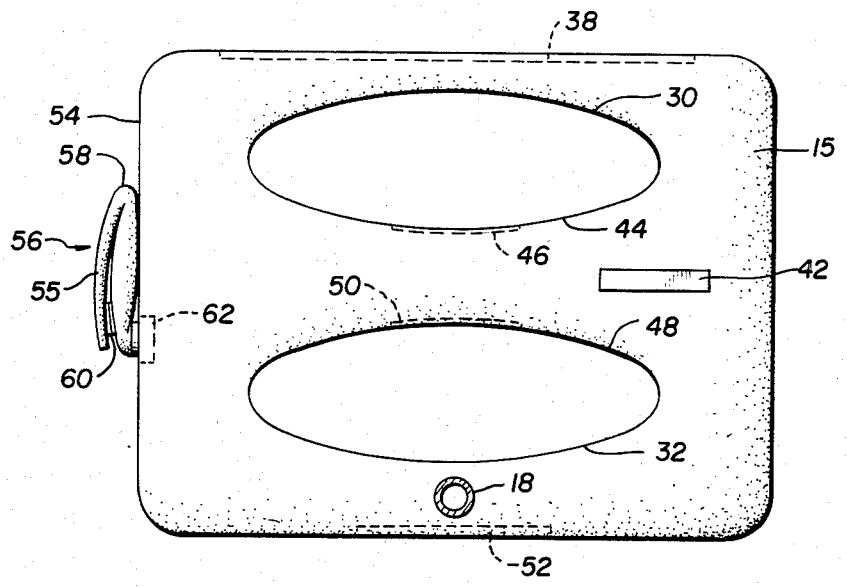
FIG. 2 is a front view of the bath lift uninflated, but expanded vertically.
Figure 3:
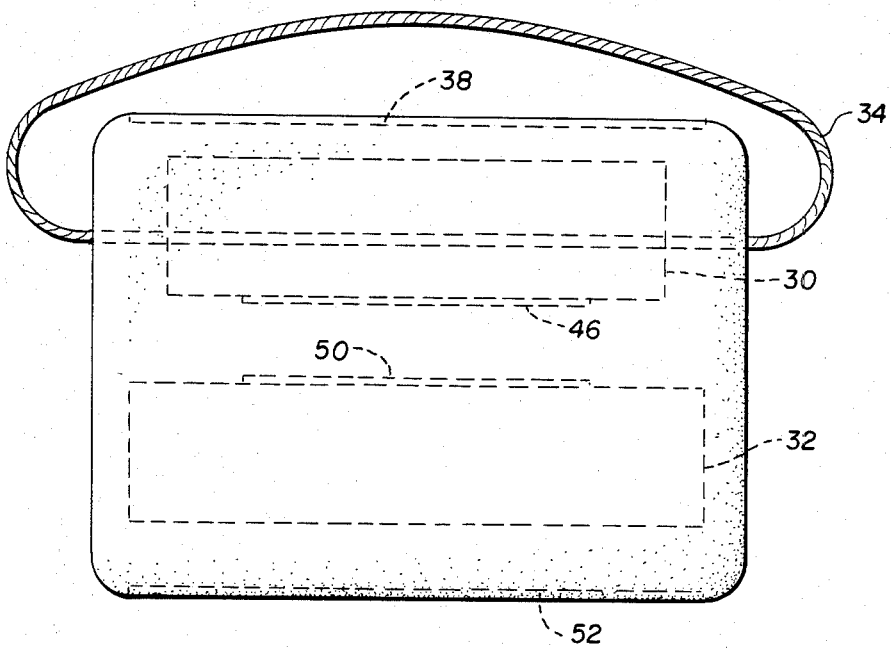
FIG. 3 is a side view of the bath lift uninflated, but expanded vertically.
Figure 4:
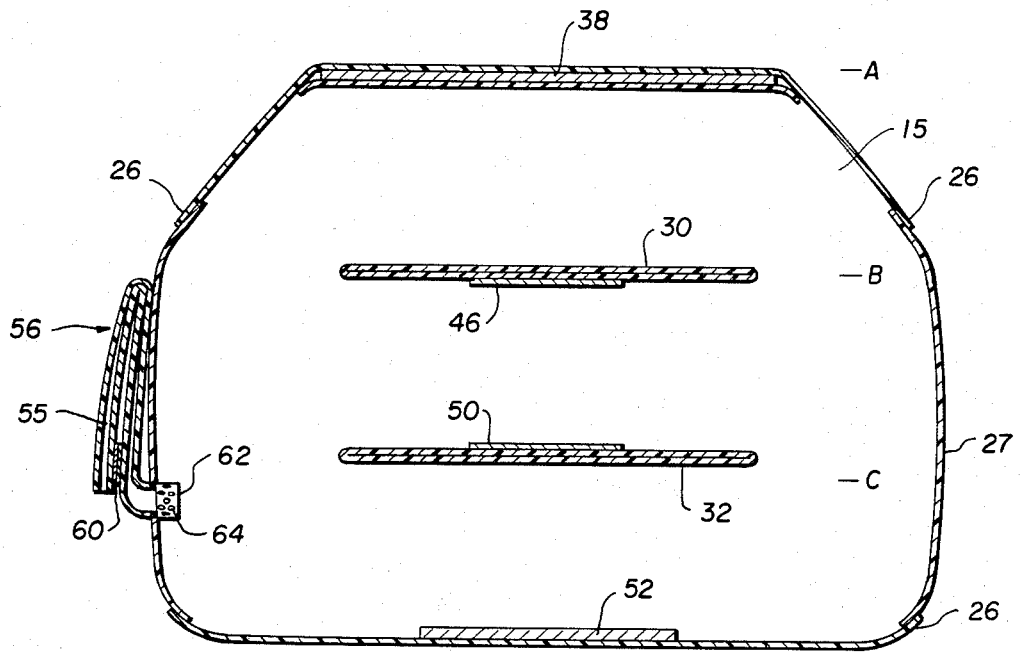
FIG. 4 is a sectional view taken along lines 4—4 in FIG. 1, with the cushion lift inflated with water.

Referring now to FIGS. 2 and 3, further details of the construction can be seen. When uninflated but expanded, it is apparent that the shell has a rectangular cross section both laterally and longitudinally. The shorter tube 30 and the elliptical cross section of the tubes 30 and 32 contribute to the pyramidal top shape and the curved indentation 36 shown in FIG. 1. The upper tube 30 has an outside lower face 44 provided with a loop type fabric surface 46, and the lower tube 32 has an outside upper face 48 provided with hook type fabric 50. These can be of the well known type manufactured and sold under the trademark VELCRO. Other suitable means for increasing the friction between the outside lower face 44 and the outside upper face 48 may be substituted.

As seen in FIGS. 2, 3 and 4, the shell is also provided with a lower stiffening board 52.

As can be seen in FIGS. 2 and 4, a lateral wall 54 of the shell is provided with a drainage valve 56 of the same design as the main closure valve 20. The drainage valve is a flap type valve which includes a flexible tube 55 folded back on itself at 58 and held in that position by hook and loop type fabric surfaces 60. The tube 55 opens into the interior of shell 15 at an orifice ring 62. Preferably the orifice ring 62 is relatively rigid and has perforations 64 to assure communication between the interior of shell 15 and tube 55, even when a portion of shell 15 or of tubes 30 or 32 cover the mouth of orifice ring 62.

Certain of the advantages of the operation of the cushion lift as described can be seen from reference to FIG. 4. In FIG. 4 the shell 15 is fully inflated and main closure valve 20 (not shown in FIG. 4) is closed. The water pressure within the shell 15 flattens elliptical tubes 30 and 32 shut and projects the top of platform having stiffening board 38 upwardly in a tapered pyramidal fashion. The tube 55 of drainage valve 56 is shut, not only by the hook and loop fabric closure 60, but also by the pressure against the side wall of the bathtub. With the shell in this condition the user sits on the top platform and swings his legs into the tub. Then he or she opens main closure valve 20. The weight of the user on shell 15 forces water in the shell to rush out of main closure valve 20, thereby deflating the shell. The initial deflation causes the top platform to move from elevation A to elevation B more quickly than the equal vertical distance from B to C, by virtue of the reduced volume of the tapered pyramidal top portion of shell 15. Thus the period of time during which the shell is in motion at its apex, i.e. the period of time during which a person with impaired mobility might be vulnerable to panic from any instability, is a minimum. Moreover, as the stiffening board 38 descends to the level B, the pyramid becomes inverted, so that the side portions of the shell abut and grip the hips of the user and provide additional security as the top platform continues its descent to the floor of the bathtub.

Moreover, the incidence of any instability in the shell is minimal. Side to side motion is eliminated because the shell is wedged between the sidewalls of the bathtub. Front to rear motion is inhibited by the constraints of the elliptical tubes 30 and 32, and this is further enhanced by the friction between the stiffening board 38 and the tube 30. Also, the friction enhancing means on the outside lower face 44 and outside upper face 48 locks the tubes together, further preventing motion.

When the hook type fabric 50 and loop type fabric 46 engage with one another, front to rear sliding between the tubes is eliminated. Thus, stability does not decrease as the bather descends to the floor of the tub.

At the beginning of shell inflation the tubes 30 and 32 are engaged by their fabrics 46 and 50 and separate only when the shell reaches a certain level of inflation. The top platform moves up at a constant rate until it reaches about the elevation B, and from there to elevation A rises rapidly, so that the period of time when the user stays on the shell near the top of the bathtub sidewall is at a minimum.

When it is desired to transport the apparatus for travelling or any other reason, the shell can be carried by carrying strap 34. It can be completely drained of water by opening drainage valve 56 and turning it sideways.

In constructing the main closure valve 20, a hook and loop type fabric closure such as closure 60 may be used. It is preferable that the area of the fabric of the closure be selected to limit the strength of the bond between the fabric so that in the event of an excessive pressure within the shell, the fabrics will separate and the valve will open, releasing the excess pressure. Other pressure relief mechanisms may also be used.

During construction of the shell, access to the interior of the shell to make the lap welds can be obtained through one of the tube ends.

What is claimed is:

1. An apparatus for enabling a person with impaired mobility to enter and leave a bathtub comprising:

a water-inflatable cushion lift assembly shell having a shape such that when fully inflated said shell wedges between opposed bathtub sidewalls, said shell, when fully inflated, having a bottom portion engaging the bottom of the bathtub and inwardly tapering upper side portions extending to the top of said shell and defining a platform at about the level of the top of said sidewalls of the bathtub, the volume defined by said tapered portion of said inflated shell being lesser than the volume within the remainder of said shell defined by a height equivalent to the height of said tapered portion, whereby a person with impaired mobility seated upon said platform may lower and raise himself into and out of the bathtub by releasing and adding water from and to the shell, respectively, and whereby the period of time required to transit a vertical distance between the top of the sidewalls of the bathtub and below the top of said sidewalls, said distance being the height of said tapered portion of the shell, is briefer than the time to transit an additional comparable vertical distance below the top of said sidewalls by virtue of the reduced volume of said tapered top of said shell.

2. An apparatus as claimed in claim 1 wherein said tapered sides of said shell are pyramidal.

3. An apparatus as claimed in claim 1 wherein a tube passes substantially horizontally through said shell.

4. An apparatus as claimed in claim 3 wherein two of said tubes are provided, said tubes being spaced apart vertically and being elliptical in cross section with a major axis of the ellipse extending horizontally through said shell.

5. An apparatus as claimed in claim 4 wherein the upper tube has an outside lower face and the lower tube has an outside upper face and said outside lower face and outside upper face are provided with means for increasing friction therebetween.

6. An apparatus as claimed in claim 5 wherein said means for increasing friction are hook and loop fabric surfaces affixed to said tubes.

7. An apparatus as claimed in claim 4 wherein the upper tube is shorter than the lower tube.

8. An apparatus as claimed in claim 7 wherein the upper tube has an outside lower face and the lower tube has an outside upper face and said outside lower face and outside upper face are provided with means for increasing friction therebetween.

9. An apparatus as claimed in claim 8 wherein said means for increasing friction are hook and loop fabric surfaces affixed to said tubes.

10. An apparatus as claimed in claim 4 wherein the interiors of said tubes are open to the outside of said shell.

11. An apparatus as claimed in claim 10 wherein a carrying strap is provided extending through one of said tubes.

12. An apparatus as claimed in claim 1 wherein said shell is made of sheet material and seams in said shell are lap welds of said sheet material.

13. An apparatus as claimed in claim 1 wherein said shell has a lateral wall facing one of said bathtub sidewalls and said lateral wall is provided with a drainage valve.

14. An apparatus as claimed in claim 13 wherein said drainage valve is a flap valve.

15. An apparatus as claimed in claim 1 wherein said shell is provided with means for indicating the temperature of water therein.

16. An apparatus for enabling persons with impaired mobility to enter and leave a bathtub comprising:

a water inflatable shell having a shape such that when fully inflated the shell wedges between opposed bathtub sidewalls, said shell having two vertically spaced apart tubes passing substantially horizontally through said shell substantially parallel to said sidewalls, said tubes being elliptical in cross section, with the major axis of the ellipse extending horizontally through said shell, the volume within said shell as defined between the height from the top of said shell, when fully inflated, to said tube closest to the top of said shell, being lesser than the volume within the remainder of said shell defined by a height equivalent to said height, whereby a person with impaired mobility seated upon said shell may lower and raise himself into and out of the bathtub by releasing and adding water from and to the shell, respectively, whereby the period of time required to transit the vertical distance from the top of said shell to said elliptical tube closest to the top of said shell is briefer than the period of time to travel an additional comparable vertical distance by virtue of the reduced volume within the shell between the top of said shell and the tube closest thereto.

17. An apparatus as claimed in claim 16 wherein the upper tube is shorter than the lower tube.

18. An apparatus as claimed in claim 17 wherein the upper tube has an outside lower face and the lower tube has an outside upper face and said outside lower face and outside upper face are provided with means for increasing friction therebetween.

19. An apparatus as claimed in claim 18 wherein said means for increasing friction are hook and loop fabric surfaces affixed to said tubes.

20. An apparatus for enabling persons with impaired mobility to enter and leave a bathtub comprising a water inflatable shell configured such that when fully inflated the shell wedges between opposed bathtub sidewalls, said shell having upper and lower tubes vertically spaced from each other and passing substantially horizontally through said shell substantially parallel to said sidewalls, the volume within said shell, when fully inflated, defined by the height from the top of said shell to said upper tube, being smaller than the volume of a comparable height of the remainder of said shell, so that the period of time required by a person seated on said shell to transit the vertical distance defined by the top of the shell to the upper tube is less than the period of time required to travel the same vertical distance with the remainder of the shell.

* * * * *